US008215445B2

(12) United States Patent
Wildhagen et al.

(10) Patent No.: US 8,215,445 B2
(45) Date of Patent: Jul. 10, 2012

(54) ELECTROACOUSTIC TRANSDUCER

(75) Inventors: Jens Wildhagen, Burgdorf (DE); Jan Peter Kuhtz, Celle (DE); Axel Grell, Burgdorf (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 12/518,078

(22) PCT Filed: Dec. 10, 2007

(86) PCT No.: PCT/EP2007/063602

§ 371 (c)(1),
(2), (4) Date: Oct. 26, 2010

(87) PCT Pub. No.: WO2008/068349

PCT Pub. Date: Jun. 12, 2008

(65) Prior Publication Data

US 2011/0031061 A1 Feb. 10, 2011

(30) Foreign Application Priority Data

Dec. 8, 2006 (DE) ..... 10 2006 058 369

(51) Int. Cl.

| | |
|---|---|
| ***G10K 13/00*** | (2006.01) |
| ***H04R 7/02*** | (2006.01) |
| ***H04R 7/14*** | (2006.01) |
| *H04R 7/00* | (2006.01) |
| *H04R 7/12* | (2006.01) |

(52) U.S. Cl. ..... 181/173; 181/171; 181/167; 181/165; 381/429; 381/426

(58) Field of Classification Search ..... 181/173, 181/172, 171, 174, 167, 168, 169, 170, 164, 181/165; 381/429, 432, 423, 430, 392, 426, 381/427, 428

See application file for complete search history.

(56) References Cited

U.S. PATENT DOCUMENTS

| | | | | | |
|---|---|---|---|---|---|
| 1,832,608 | A | * | 11/1931 | Abrahams | 181/171 |
| 1,872,583 | A | | 8/1932 | Hawley | |
| 1,891,566 | A | * | 12/1932 | McKellip | 181/172 |
| 2,030,501 | A | * | 2/1936 | Cunningham | 181/172 |
| 2,439,665 | A | * | 4/1948 | Marquis | 181/169 |
| 2,502,853 | A | | 4/1950 | Edward | |
| 3,154,173 | A | * | 10/1964 | Petrie | 181/172 |
| 4,100,992 | A | * | 7/1978 | Rehde et al. | 181/166 |
| 4,254,184 | A | * | 3/1981 | Tsukagoshi et al. | 428/408 |
| 4,324,312 | A | * | 4/1982 | Durbin | 181/171 |
| 4,433,214 | A | * | 2/1984 | Jasinski | 381/398 |

(Continued)

FOREIGN PATENT DOCUMENTS

| | | |
|---|---|---|
| DE | 10328380 | 2/2004 |

(Continued)

OTHER PUBLICATIONS

International Search and Preliminary Report on Patenability for application PCT/EP2007/063602 (Jul. 7, 2009).

*Primary Examiner* — Edgardo San Martin
(74) *Attorney, Agent, or Firm* — Kilpatrick Townsend & Stockton LLP

(57) ABSTRACT

Provided is an electroacoustic transducer having a diaphragm (10). The diaphragm (10) has a first and a second region (20, 30), wherein the hardness, stiffness or compliance of the first region (20) differs from the second region (30).

9 Claims, 1 Drawing Sheet

U.S. PATENT DOCUMENTS

| | | | | |
|---|---|---|---|---|
| 4,646,874 | A * | 3/1987 | Baitcher et al. | 181/169 |
| 5,892,185 | A * | 4/1999 | Takahashi et al. | 181/171 |
| 6,039,145 | A | 3/2000 | Ogura et al. | |
| 6,176,345 | B1 * | 1/2001 | Perkins et al. | 181/173 |
| 6,697,496 | B2 * | 2/2004 | Frasl | 381/398 |
| 6,920,957 | B2 * | 7/2005 | Usuki et al. | 181/173 |
| 6,944,310 | B2 * | 9/2005 | Ito et al. | 381/386 |
| 7,277,556 | B2 * | 10/2007 | Akino | 381/430 |
| 7,428,946 | B2 * | 9/2008 | Honda et al. | 181/171 |
| 7,558,399 | B2 * | 7/2009 | Akino | 181/167 |
| 2007/0071276 | A1 * | 3/2007 | Kudo | 381/426 |
| 2007/0187171 | A1 * | 8/2007 | Suzuki et al. | 181/167 |
| 2009/0304225 | A1 * | 12/2009 | Kamimura et al. | 381/423 |

FOREIGN PATENT DOCUMENTS

| | | | | |
|---|---|---|---|---|
| EP | 0508596 | | | 10/1992 |
| EP | 0508596 | A | | 10/1992 |
| FR | 2562369 | | | 10/1985 |
| FR | 2562369 | A | | 10/1985 |
| JP | 52-101022 | A | | 8/1977 |
| JP | 58114696 | A | * | 7/1983 |
| JP | 59055698 | A | * | 3/1984 |
| JP | 59176995 | A | * | 10/1984 |
| JP | 60047597 | A | * | 3/1985 |
| JP | 52 101022 | | | 3/2000 |
| WO | WO/2004/017672 | | | 2/2004 |

* cited by examiner

ELECTROACOUSTIC TRANSDUCER

CROSS-REFERENCE TO RELATED APPLICATIONS

This application is a U.S. National Stage of PCT/EP2007/063602 filed Dec. 10, 2007, which claims priority to German Application No. 10 2006 058369.8, filed Dec. 8, 2006, the contents of which is incorporated herein by reference.

BACKGROUND

The present invention concerns an electroacoustic transducer and a diaphragm for an electroacoustic transducer.

Diaphragms for electroacoustic transducers can involve different levels of stiffness, in which respect usually different materials involving different levels of stiffness are assembled to produce a corresponding diaphragm.

In the case of such diaphragms however it is found to be disadvantageous as both eigenmodes and also resonances occur.

Assembling different materials to obtain a corresponding diaphragm represents a costly solution as well as a relatively complicated and expensive production procedure.

DE 103 28 380 A1 discloses a sound transducer with a sealed rear volume chamber which is small in relation to the transducer. The relationship between the diaphragm mass and the rear volume is so selected that the spring stiffness of the diaphragm restraint arrangement is selected to be so low that it is significantly below the spring stiffness of the enclosed rear volume.

SUMMARY

Therefore the object of the present invention is to provide an electroacoustic transducer having a diaphragm with a variable stiffness, strength or compliance.

The object of the present invention is attained by an electroacoustic transducer comprising a diaphragm which has at least a first and a second region, wherein the stiffness of the first region differs from the stiffness of the second region.

Thus there is provided an electroacoustic transducer having a diaphragm. The diaphragm has first and second regions, wherein the hardness, stiffness (rigidity) or compliance of the first region differs from the first region.

The invention is based on the notion of providing a diaphragm having soft or pliant corrugations and a hardened spherical cup portion. The diaphragm thus has different levels of hardness or stiffness in different regions. Preferably at least a part of the diaphragm is hardened or stiffened for example by beam-crosslinking.

Thus it is possible to obtain a diaphragm having a low resonance frequency and very good high radiation, wherein the diaphragm is made from a single material.

Further aspects of the invention are subject-matter of the appendant claims.

BRIEF DESCRIPTION OF THE DRAWINGS

The advantages and embodiments by way of example of the present invention are described in greater detail hereinafter with reference to the drawing.

DETAILED DESCRIPTION

Figure 1:
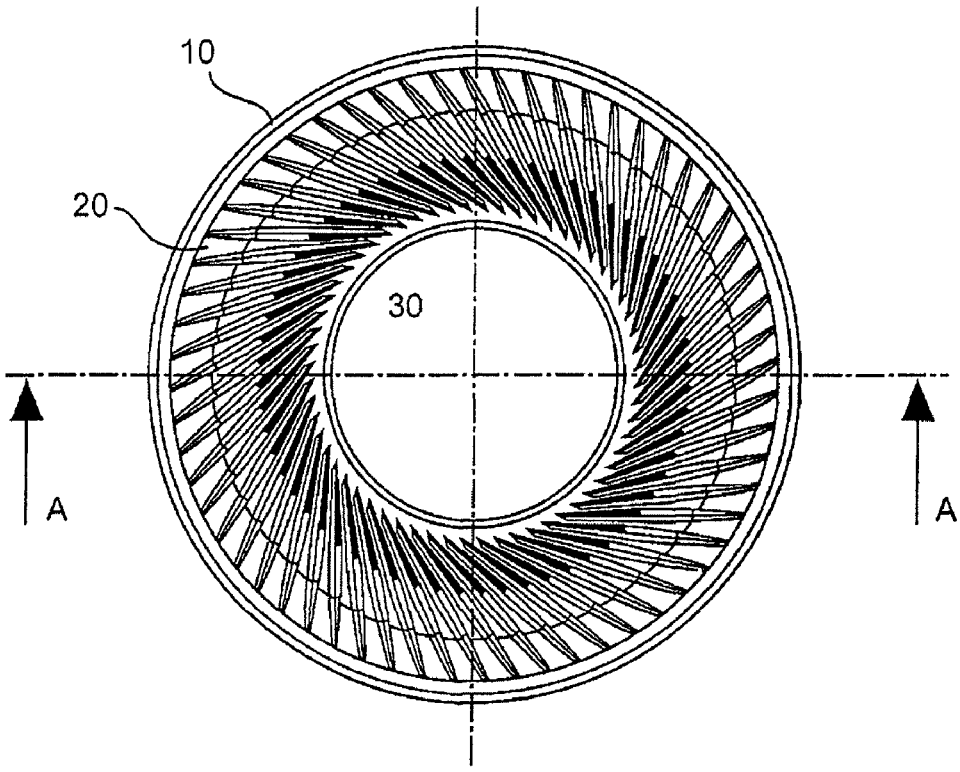
FIG. 1 shows a diagrammatic plan view of a diaphragm in accordance with a first embodiment.

FIG. 1 shows a diagrammatic plan view of a diaphragm in accordance with a first embodiment. In this case the diaphragm 10 has a corrugation 20 and a spherical cup portion 30.

Figure 2:
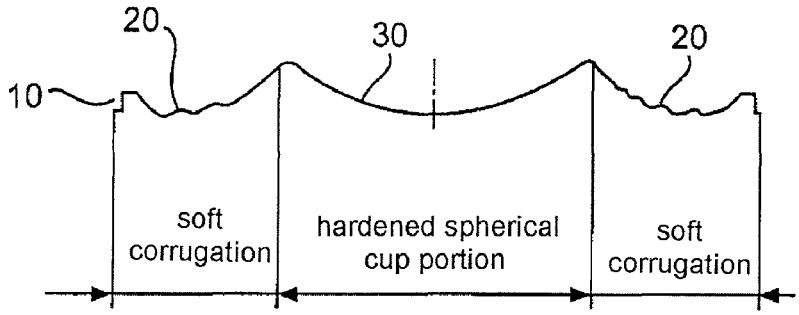
FIG. 2 shows a sectional view of the diaphragm of FIG. 1.

FIG. 2 shows a sectional view along line A-A of the diaphragm of FIG. 2. The diaphragm thus has two corrugation portions 20 and a spherical cup portion 30. Preferably the corrugations are of a soft or pliant nature while the spherical cup portion has been hardened or stiffened, that is to say the spherical cup portion is of higher stiffness than the corrugation portions. In addition the diaphragm can be produced from one material or in one piece, in which case the spherical cup region 30 can be subsequently hardened or stiffened. That subsequent hardening or stiffening can be effected for example by beam-crosslinking, in which case hardening or stiffening can be effected by an interlinkage of plastic material molecules. In that situation the corrugation regions 20 are not hardened or stiffened so that they are soft or are of a low level of stiffness. As already described hereinbefore the diaphragm is preferably made from a homogeneous material and optionally subsequently treated. Preferably in that case no further material is applied, in the sense of a coating, a dye or a lacquer. Rather the diaphragm is subjected to a treatment in which the properties of the material of the diaphragm are altered (hardened).

A reduction in eigenmodes can be achieved by the partially hardened or stiffened diaphragm. A low resonance frequency can also be made possible.

Furthermore the stiffness (compliance) of the corrugation can be reduced (increased) in the transitional region between the corrugation and the spherical cup portion. Alternatively the stiffness of the corrugation can decrease towards the edge regions. The spherical cup portion can also be at least partially (subsequently) hardened or stiffened.

The above-described electroacoustic transducer can be used in an electronic device such as for example a microphone, a cellular telephone, a loudspeaker or the like.

The invention claimed is:

1. An electroacoustic transducer comprising:

a diaphragm which has at least a first and a second region, wherein the stiffness of the first region differs from the stiffness of the second region, wherein the diaphragm is produced from a one-piece material, wherein the diaphragm is subject to a treatment in which the properties of the material of the second region of the diaphragm are hardened, wherein no further material is applied to the second region of the diaphragm.

2. An electroacoustic transducer as set forth in claim 1 wherein the first region represents a corrugation and the second region represents a spherical cup portion.

3. An electroacoustic transducer as set forth in claim 2 wherein the region of the spherical cup portion is subsequently at least partially stiffened.

4. An electroacoustic transducer as set forth in claim 2 wherein the stiffness of the corrugation or spherical cup portion decreases in a transitional region between the corrugation and the spherical cup portion.

5. An electroacoustic transducer as set forth in claim 1 wherein the diaphragm is of a one-piece configuration.

6. A diaphragm for an electroacoustic transducer comprising a corrugation and a spherical cup portion wherein the corrugation and the spherical cup portion are of different levels of stiffness, wherein the diaphragm is subject to a treatment in which properties of a material of the spherical cup portion are hardened, wherein no further material is applied to the spherical cup portion of the diaphragm.

7. An electroacoustic transducer as set forth in claim 2 wherein a compliance of the corrugation or spherical cup portion increases in a transitional region between the corrugation and the spherical cup portion.

8. An electroacoustic transducer as set forth in claim 1, wherein the hardening of the diaphragm is effected by beam cross-linking.

9. An electroacoustic transducer as set forth in claim 1, wherein the diaphragm is comprised of a homogeneous material.

* * * * *

UNITED STATES PATENT AND TRADEMARK OFFICE

CERTIFICATE OF CORRECTION

PATENT NO. : 8,215,445 B2
APPLICATION NO. : 12/518078
DATED : July 10, 2012
INVENTOR(S) : Wildhagen et al.

It is certified that error appears in the above-identified patent and that said Letters Patent is hereby corrected as shown below:

In the Specification:

Column 1, Line 9: please delete “is” and insert --are--.

Column 1, Line 9: after “by reference” please insert --for all purposes--.

Column 1, Line 20: please place a --,-- after “such diaphragms”.

Column 1, Line 20: please place a --,-- after “however”.

Column 1, Line 28: please place a --,-- after “chamber”.

Column 1, Line 38: please place a --,-- after “Therefore”.

Column 1, Line 40: please place a --,-- after “strength”.

Column 1, Line 45: please place a --,-- after “Thus”.

Column 1, Line 49: please delete “from the first region” and insert --from the second region--.

Column 1, Line 54: please place a --,-- after “stiffened”.

Column 1, Line 54: please place a --,-- after “example”.

Column 1, Line 56: please place a --,-- after “Thus”.

Column 1, Line 67: please delete “drawing” and insert --drawings--.

Column 2, Line 2: please delete the “,” after “embodiment” and insert --;--.

Column 2, Line 8: please place a --,-- after “In this case”.

Column 2, Line 16: please delete the “,” after “stiffened” and insert --;--.

Signed and Sealed this
Eighth Day of January, 2013

David J. Kappos

David J. Kappos
*Director of the United States Patent and Trademark Office*

Column 2, Line 18: please place a --,-- after “In addition”.

Column 2, Line 22: please place a --,-- after “effected”.

Column 2, Line 23: please place a --,-- after “example”.

Column 2, Line 25: please place a --,-- after “In that situation”.

Column 2, Line 27: please place a --,-- after “hereinbefore”.

Column 2, Line 29: please place a --,-- after “Preferably”.

Column 2, Line 29: please place a --,-- after “in that case”.

Column 2, Line 32: please place a --,-- after “Rather”.

Column 2, Line 38: please place a --,-- after “Furthermore”.

Column 2, Line 40: please place a --,-- after “Alternatively”.

Column 2, Line 45: please place a --,-- after “such as”.

Column 2, Line 45: please place a --,-- after “for example”.

Column 2, Line 46: please place a --,-- after “loudspeaker”.

<u>In the Claims</u>:

Column 2, Line 57, Claim 1: after “hardened” and before “wherein” please insert --and--.

Column 3, Line 11, Claim 6: after “hardened” and before “wherein” please insert --and--.